US007864152B2

(12) United States Patent
Park et al.

(10) Patent No.: US 7,864,152 B2
(45) Date of Patent: Jan. 4, 2011

(54) LIQUID CRYSTAL DISPLAY OF FIELD SEQUENTIAL COLOR TYPE AND METHOD FOR DRIVING THE SAME

(75) Inventors: Ki Bok Park, Gunpo-si (KR); Gi-Hong Kim, Anyang-si (KR); Seong Ho Cho, Mokpo-si (KR)

(73) Assignee: LG Display Co., Ltd., Seoul (KR)

( * ) Notice: Subject to any disclaimer, the term of this patent is extended or adjusted under 35 U.S.C. 154(b) by 842 days.

(21) Appl. No.: 11/479,368

(22) Filed: Jun. 29, 2006

(65) Prior Publication Data

US 2007/0152945 A1 Jul. 5, 2007

(30) Foreign Application Priority Data

Dec. 30, 2005 (KR) ..... 10-2005-0134985

(51) Int. Cl.
*G09G 3/36* (2006.01)

(52) U.S. Cl. ..... 345/98; 345/99; 345/102

(58) Field of Classification Search ..... 345/87–104, 345/690

See application file for complete search history.

(56) References Cited

U.S. PATENT DOCUMENTS 6,151,004 A * 11/2000 Kaneko ..... 345/88
6,476,784 B2 * 11/2002 Zavracky et al. ..... 345/88

(Continued)

FOREIGN PATENT DOCUMENTS

JP 11-271709 10/1999

(Continued)

OTHER PUBLICATIONS

Office Action issued in corresponding Japanese Patent Application No. 2006-174173, mailed Apr. 21, 2009.

*Primary Examiner*—Bipin Shalwala
*Assistant Examiner*—Keith Crawley
(74) *Attorney, Agent, or Firm*—Brinks Hofer Gilson & Lione

(57) ABSTRACT

Disclosed are a liquid crystal display, which can increase a design margin upon designing a driving timing chart, improve picture quality characteristics and reduce power consumption, and a method for driving the same. The liquid crystal display of a field sequential color type comprises an LCD panel having a plurality of pixels arranged in a matrix form defined by gate lines and data lines crossing each other, a sub-field time setting unit for selecting 1 horizontal period according to an externally input frame frequency and a first user-set signal and determining a wait period and a flash period corresponding to the 1 horizontal period according to second and third user-set signals, a timing controller for producing and outputting a gate control signal and a data control signal corresponding to the 1 horizontal period and the wait period and a light source control signal corresponding to the wait period and a re-aligned pixel data, a gate driver for sequentially outputting a scan pulse to the gate lines according to the gate control signal, a data driver for outputting a data voltage to the data lines every 1 horizontal period according to the data control signal, and a backlight unit for sequentially outputting red, green and blue light to the pixels, respectively, according to the control of the timing controller.

8 Claims, 6 Drawing Sheets

U.S. PATENT DOCUMENTS

| | | | | |
|---|---|---|---|---|
| 6,972,736 | B1 | 12/2005 | Wada et al. | |
| 2004/0217932 | A1* | 11/2004 | Nally et al. | 345/92 |
| 2005/0259064 | A1* | 11/2005 | Sugino et al. | 345/102 |
| 2006/0007093 | A1* | 1/2006 | La | 345/96 |

FOREIGN PATENT DOCUMENTS

| | | |
|---|---|---|
| JP | 2004-163828 | 6/2004 |
| WO | 00/33288 | 12/1999 |

* cited by examiner

| RTN | 1H Period | RTSEL | Number of 1H Clocks | BTSEL | Number of 1H Clocks |
|---|---|---|---|---|---|
| 5h'00~0F | Setting Disabled | 000 | 150 Clock | 000 | 320 Clock |
| 5h'10 | 2.50μs | 001 | 170 Clock | 001 | 340 Clock |
| 5h'11 | 2.66μs | 010 | 190 Clock | 010 | 360 Clock |
| 5h'12 | 2.81μs | 011 | 210 Clock | 011 | 380 Clock |
| ⋮ | ⋮ | 100 | 230 Clock | 100 | 400 Clock |
| 5h'1D | 4.53μs | 101 | 250 Clock | 101 | 420 Clock |
| 5h'1E | 4.69μs | 110 | 270 Clock | 110 | 440 Clock |
| 5h'1F | 4.84μs | 111 | 290 Clock | 111 | 460 Clock |

LIQUID CRYSTAL DISPLAY OF FIELD SEQUENTIAL COLOR TYPE AND METHOD FOR DRIVING THE SAME

This nonprovisional application claims priority under 35 U.S.C. §119(a) on Patent Application No. 2005-0134985 filed in Republic of Korea on Dec. 30, 2005, the entire contents of which are hereby incorporated by reference.

BACKGROUND

1. Field

A liquid crystal display and a method for driving the same are provided.

2. Related Art

A liquid crystal display displays a desired image by forming a liquid crystal layer that has an anisotropic dielectric constant on a transparent insulating substrate on the top and bottom sides, adjust the strength of electric fields to change the molecular arrangement of the liquid crystal material and, regulates the amount of liquid transmitted to the transparent insulating substrate.

A thin film transistor liquid crystal display (TFT LCD) using a thin film transistor (TFT) as a switching device is commonly used in electrical appliances. Such a liquid crystal display comprises an LCD panel composed of pixels defined by gate lines and data lines that cross each other and display images. A driver drives the liquid crystal panel. A backlight unit supplies light to the LCD panel.

The backlight unit uses, for example, a cold cathode fluorescent lamp (CCFL) or a light emitting diode (LED). The light emitting diode has good power consumption, weight, and brightness, and is used in devices that need to be smaller, thinner and more lightweight.

The backlight unit that uses a light emitting diode as a light source, generally uses a field sequential color (FSC) driving method to get a better picture quality.

The field sequential color (FSC) driving method is a method that displays a color by utilizing an afterimage effect of human eyes by sequentially driving three primary color red, green and blue sources without using red, green blue color filters when displaying a color.

FIG. 1 is a timing chart that explains a method that drives a liquid crystal display of a field sequential color type according to the prior art.

As shown in FIG. 1, in the field sequential color type driving method, one frame on an LCD panel is divided into three sub-frames of red (R), green (G) and blue (B). For example, if the driving frequency is 60 Hz, one frame has a time interval of 16.7 ms, and each frame is divided into sub-frames of red (R), green (G) and blue (B) of 5.56 ms.

Each sub-frame is divided into an addressing period (AP) that writes data by scanning a thin film transistor, a wait period (WP) and a flash period (FP). The addressing period (AP) represents a data writing time. The wait period (WP) represents a LCD response time. The flash period (FP) represents a backlight driving time. The actual flash period (FP) according to each color is a period of time excluding the addressing period (AP) and the wait period (WP). The addressing period (AP) is a gate-on time of all of scan pulses sequentially applied to gate lines of the LCD panel that equals to a value obtained by multiplying a horizontal period for one line (1H period) with the total number of scan lines.

Red, green and blue pixel data of the LCD panel are sequentially generated once in the same ratio (R:G:B=1:1:1) within 1 vertical period, and the backlight unit is also synchronized in the same way to sequentially turn on light sources (light emitting diodes) of red, green and blue.

In the prior art field sequential color type driving method, the timing chart of FIG. 1 is designed such that 1 horizontal period (1H period) is determined in response to one frame, and accordingly a fixed wait period and a flash period are generated in response to the 1 horizontal period.

A design margin for the addressing period and the flash period is small. When 1 horizontal period decreases by a rise in frame frequency, a luminance deviation is generated due to the lack of the wait period, and the picture quality may be degraded due to degradations in color reproduction and contrast ratio (C/R) at a low temperature. The power consumption increases due to an increase of the number of ons and offs of the light emitting diodes. It is difficult to represent a uniform luminance due to flickering.

SUMMARY

A liquid crystal display of a field sequential color type is provided.

A liquid crystal display of a field sequential color type in accordance with one embodiment of the present comprising: an LCD panel that has a plurality of pixels arranged in a matrix form defined by gate lines and data lines that cross each other. A sub-field time setting unit that selects 1 horizontal period according to an externally input frame frequency and a first user-set signal and determines a wait period and a flash period corresponding to the 1 horizontal period according to a second and third user-set signals. A timing controller that produces and outputs a gate control signal and a data control signal corresponding to the 1 horizontal period and the wait period and a light source control signal that corresponds to the wait period and a re-aligned pixel data. A gate driver that sequentially outputs a scan pulse to the gate lines according to the gate control signal. A data driver that outputs a data voltage to the data lines every 1 horizontal period according to the data control signal. A backlight unit that sequentially outputs red, green and blue light to the pixels, respectively, according to the control of the timing controller.

One frame comprises three sub-frames of red, green and blue, and each of the sub-frames is composed of three sub-fields each consisting of a variable addressing period that corresponds to the 1 horizontal period, a wait period and a flash period.

The sub-field time setting unit selects 1 horizontal period according to the first user-set signal and varies the wait period and flash period, respectively, that corresponds to the 1 horizontal period according to the second and third user-set signals.

The sub-field time setting unit comprises a horizontal period variation unit that selects and outputs 1 horizontal period that corresponds to the frame frequency according to the first user-set signal. A wait period variation unit that varies the wait period according to the 1 horizontal period and the second user-set signal. A flash period variation unit that varies the flash period according to the 1 horizontal period and the third user-set signal.

The second and third user-set signals that determine the wait period and the flash period can be set respectively according to an ambient temperature or a luminance deviation. A user selects value stored in a memory as the first to third user-set signals. Each of the variable three sub-fields consists of a minimum setup time and a variable time.

There is provided a liquid crystal display of a field sequential color type in accordance with another embodiment comprises an LCD panel that has a plurality of pixels arranged in a matrix form defined by gate lines and data lines that cross each other. A frequency modulation unit modulates an externally input frame frequency that corresponds to one frame. A sub-field time setting unit varies setting an addressing period, a wait period and a flash period according to the frame frequency modulated in the frequency modulation unit and the first to third user-set signals. A timing controller produces and outputs a gate control signal and a data control signal that corresponds to the 1 horizontal period and the wait period and a light source control signal that corresponds to the wait period and a re-aligned pixel data. A gate driver that sequentially outputs a scan pulse to the gate lines according to the gate control signal. A data driver outputs a data voltage to the data lines every 1 horizontal period according to the data control signal. A backlight unit sequentially outputs red, green and blue light to the pixels, respectively, according to the control of the timing controller.

A method for driving a liquid crystal display of a field sequential color type in accordance with the one embodiment of the present invention, comprising: selecting 1 horizontal period that drives gate lines of an LCD panel according to a first user-set signal if a frame frequency corresponding to one frame is externally input; determining and outputting a wait period and a flash period, according to the 1 horizontal period and second and third user-set signals; producing and outputting a gate control signal and a data control signal that corresponds to the 1 horizontal period and the wait period and a light source control signal that corresponds to the wait period and a re-aligned pixel data; sequentially outputting a scan pulse to the gate lines according to the gate control signal; converting the pixel data into a data voltage and outputting the data voltage to the data lines every 1 horizontal period according to the data control signal; and sequentially outputting red, green and blue light according to the light source control signal.

The step selecting 1 horizontal period that drives gate lines of an LCD panel according to a first user-set signal comprises modulating the externally input frame frequency; and selecting 1 horizontal period for driving the gate lines of the LCD panel according to the modulated frame frequency and the first user-set signal.

Additional details and advantages of the embodiments will be set forth in the detailed description and drawings.

DRAWINGS

DESCRIPTION

A liquid crystal display of a field sequential color type and a method for driving the same in accordance with preferred embodiments will be described in detail with reference to the accompanying drawings.

Figure 2:
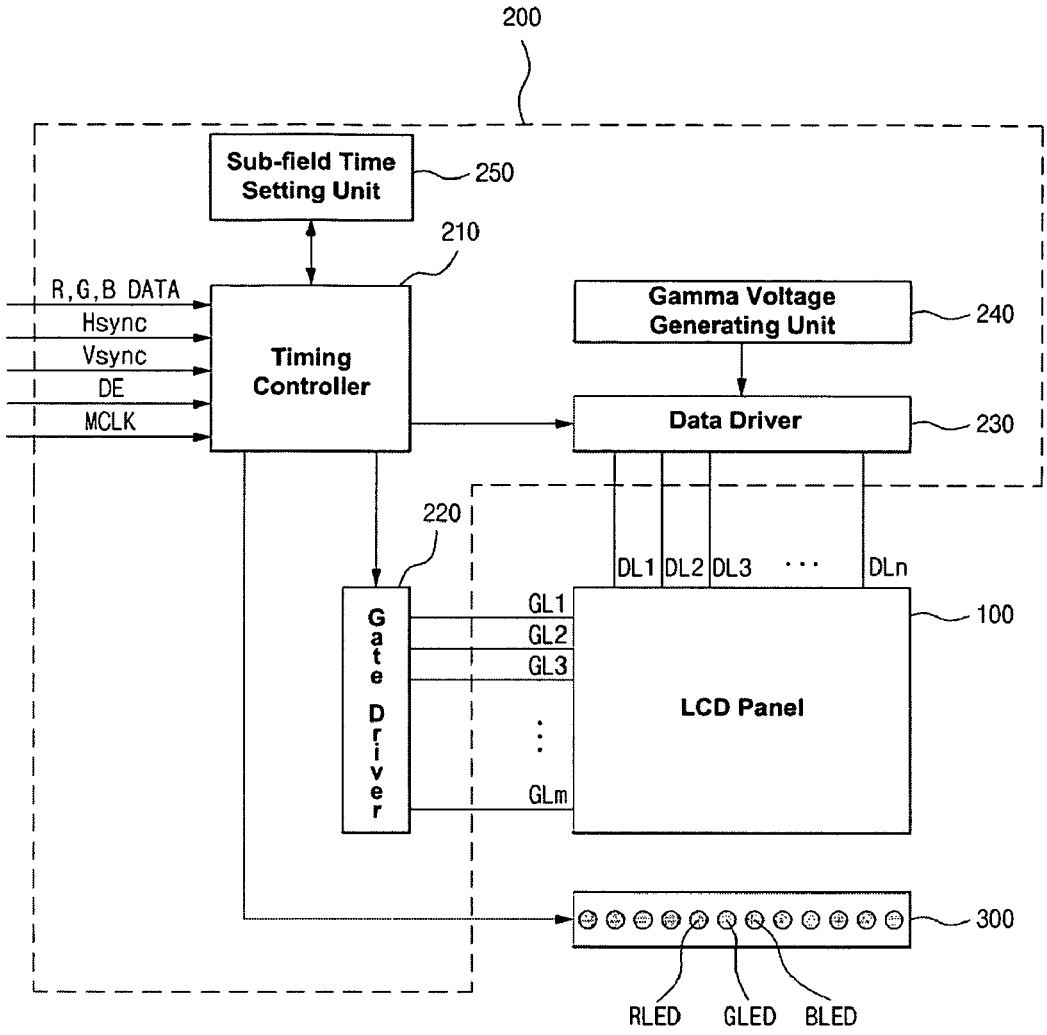
FIG. 2 is a block diagram that schematically shows a liquid crystal display of a field sequential color type according to one embodiment.

FIG. 2 is a block diagram that schematically shows a liquid crystal display of a field sequential color type in accordance with one embodiment.

As shown in FIG. 2, the liquid crystal display of the field sequential color type in accordance with one embodiment largely comprises an LCD panel 100, a driver 200 that drives the LCD panel 100, and a backlight unit 300 having red, green, and blue light sources RLED, GLED, and BLED and supplies light to the LCD panel 100.

The LCD panel 100 is configured such that a m-number of gate lines GL1, GL2, GL3, . . . , GLm and an n-number of data lines DL1, DL2, DL3, . . . , DLn are arranged to cross each other in a matrix form to define a number of pixels. If it is unnecessary to define the pixels, the m-number of gate lines GL1, GL2, GL3, . . . , GLm and the n-number of data lines DL1, DL2, DL3, . . . , DLn are commonly referred to as gate lines GL and data lines DL, respectively.

A thin film transistor and a storage capacitor are formed in each of the pixels. An image is displayed on the LCD panel 100 by a data voltage and a common voltage supplied to each pixel according to the switching operation of the thin film transistor connected to the gate lines GL and the data lines DL. The voltage sustains characteristics of the pixels are improved by the storage capacitor, thereby stabilizing a gray scale display.

The driver 200 comprises a timing controller 210, a gate driver 220, a data driver 230, a gamma voltage generating unit 240, a sub-field time setting unit 250.

The sub-field time setting unit 250 selects 1 horizontal period according to an externally input frame frequency and a first user-set signal, and varies and outputs a wait period and a flash period, according to the 1 horizontal period and second and third user settings. The 1 horizontal period means an addressing period for data writing of the gate lines by scanning the thin film transistor, for example, a gate-on time of a scan pulse applied to one of the gate lines on the LCD panel 100.

The timing controller 210 receives a horizontal synchronization signal Hsync, a vertical synchronization signal Vsync, a data enable signal DE, a main clock MCLK, and supplies required control signals (a gate control signal, a data control signal, and a light source control signal) to the gate driver 220, the data driver 230, and the backlight unit 300. Input pixel data (RGB data) are re-aligned to be supplied to the data driver 230.

The gate control signal includes a gate start pulse GSP, a gate shift clock GSC, a gate output enable GOE. The data control signal includes a source start pulse SSP, a source shift clock SSC, a source output enable signal SOE and a polarity inversion signal POL.

The gate control signal and the data control signal output from the timing controller 210 are signals that drive the gate driver 220 and the data driver 230 according to 1 horizontal period and a wait period. The light source control signal is a signal that drives the backlight unit 300 according to a flash period.

The sub-field time setting unit 250 and the timing controller 210 may be integrated as one device.

The gate driver 220 sequentially outputs a scan pulse to the gate lines GL according to a gate control signal.

The data driver 230 converts pixel data re-aligned and supplied from the timing controller 210 into a data voltage by using gamma voltages supplied from the gamma voltage generating unit 240, and outputs the data voltage to the data lines DL every 1 horizontal period according to a data control signal.

The backlight unit 300 sequentially outputs red, green, and blue light to each of the pixels on the LCD panel 100 by control of the driver 200.

Figure 3:
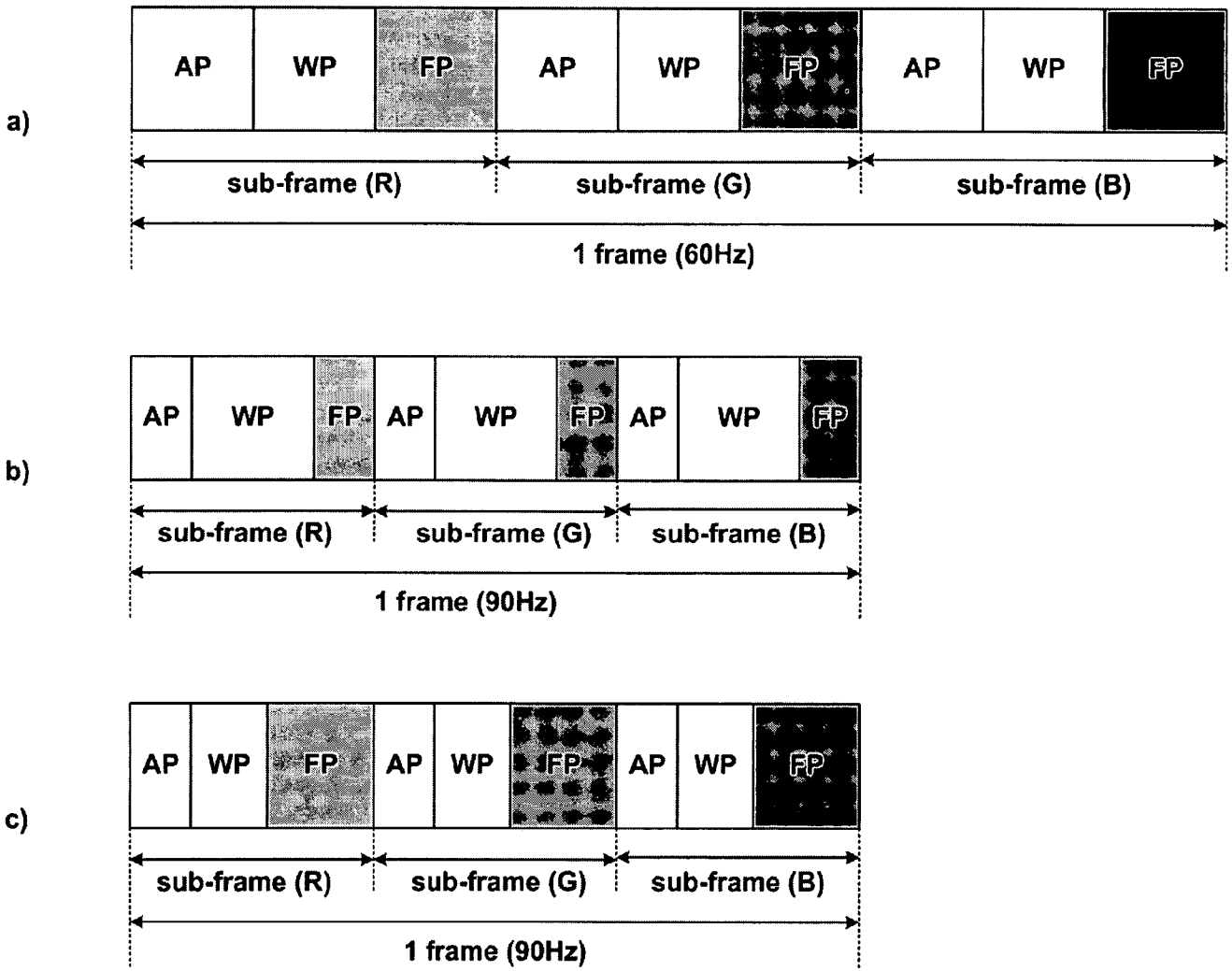
FIG. 3 is a view that shows a time setting of a sub-field time setting unit.

FIG. 3 is a view that shows a time setting of a sub-field setting unit.

As shown in FIG. 3, in accordance with the present embodiment, one frame is composed of three sub-frames of red, green and blue, and each of the sub-frames consists of an addressing period AP, a wait period WP and a flash period FP.

One frame is a value that is variable according to a user setting, and addressing period AP, the wait period WP and the flash period FP comprising one frame can be varied respectively according to a user setting.

Conventionally, as shown in (a) of FIG. 3, the frame frequency is set to 60 Hz or 90 Hz according to a standard. A timing chart was designed in a manner that when one frame and sub-frames are fixed, an addressing period AP, a wait period WP and a flash period FP are determined within the range of the fixed sub-frames.

For example, if it is desired to increase the flash period FP because of a low luminance, it is inevitable to reduce the addressing period AP or the wait period WP on the timing chart.

It is possible to increase a design margin by changing the design of the timing chart so that the address period AP, the wait period or the flash period FP can be controlled, respectively. It is possible to adjust the entire frame by varying a frame frequency input according to a standard, that is, by modulating the frequency, without needing to limit the design margin of the timing chart by fixing the frame frequency to 60 Hz or 90 Hz.

Respective variations in the addressing period AP, the wait period WP or the flash period FP are done within the range of each sub-frame preset according to the user setting. A change of the entire frame frequency is done within a predetermined range. The frame frequency can be varied within a range of, for example, 60 to 90 Hz, by modulating an externally input clock frequency, and the addressing period AP, wait period WP and flash period FP for each sub-field of the thus-varied frame frequency can be varied respectively.

For example, if a luminance deviation occurs according to a direction in which a scan pulse is applied, or a liquid crystal response speed is lengthened at a low temperature to thus cause a picture quality degradation, the luminance deviation can be improved by decreasing the addressing period AP and the flash period FP and increasing the wait period WP as shown in (b) of FIG. 3. If the previously set wait period WP is not the maximum value, the luminance deviation can be improved without degrading other characteristics by increasing only the wait period WP while maintaining the addressing period AP and the flash period FP as they are.

Since power consumption and luminance are designed by changing the flash period FP and the current of light emitting diodes RLED, GLED and BLED in the backlight unit 300. If the flash period FP can be varied individually as shown in (c) of FIG. 3, the timing chart can be optimized so that an optimum luminance can be obtained at a minimum power consumption.

Figure 4:
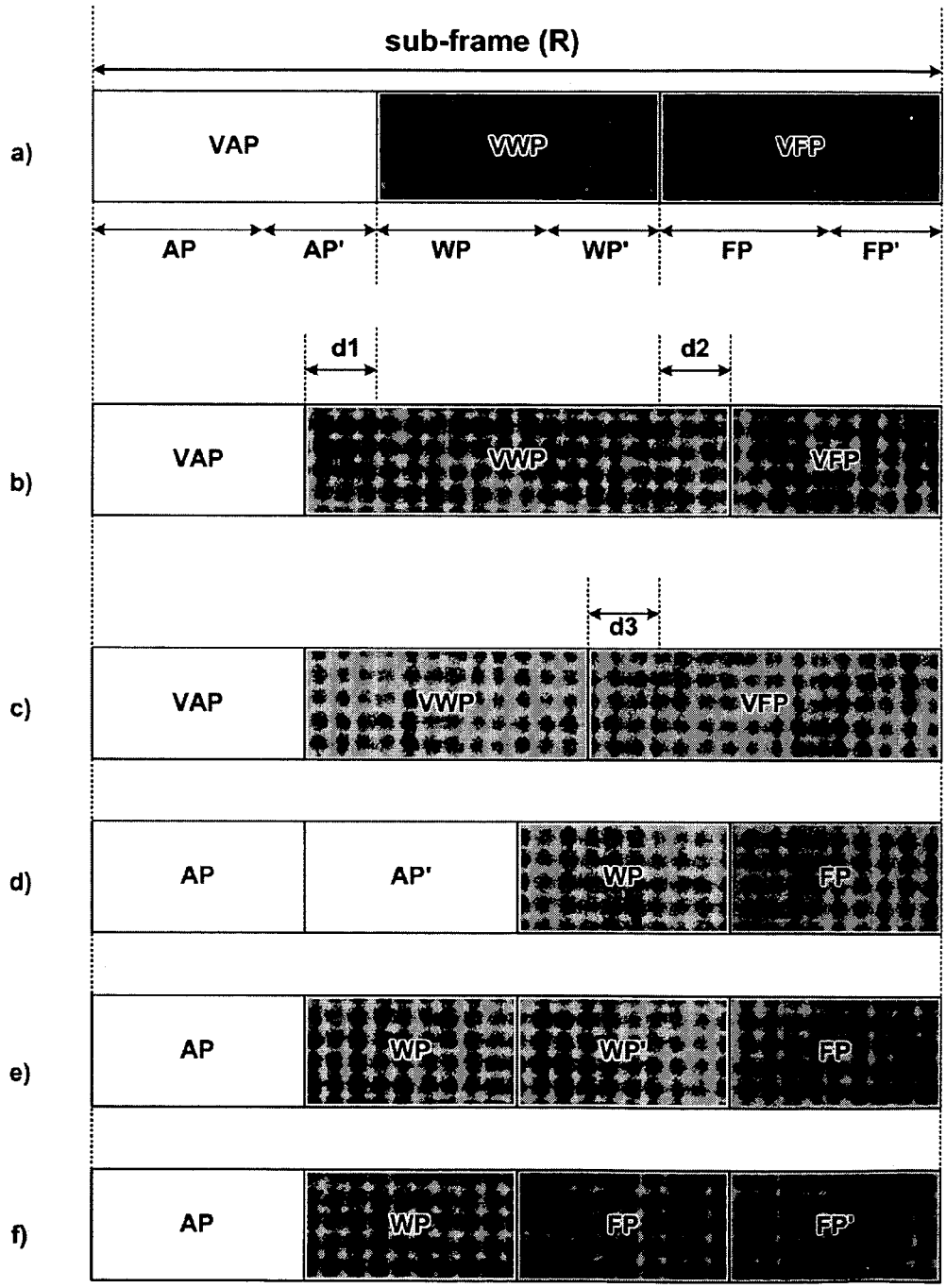
FIG. 4 is a view that explains the time setting of the sub-field time setting unit more concretely.

FIG. 4 is a view that explains the time setting of the sub-field time setting unit as shown in FIG. 2.

As shown in FIG. 4*a*, a red (R) sub-frame is composed of three variable sub-fields VAP, VWP, and VFP, and each of the variable sub-fields VAP, VWP, and VFP is composed of a sum of a physically possible minimum period AP, WP, or FP or a variable value AP', WP', or FP'. The variable value can be a value that excludes each minimum period within the range of the sub-frame (i.e., sub-frame—(AP+WP+FP).

Figure 1:
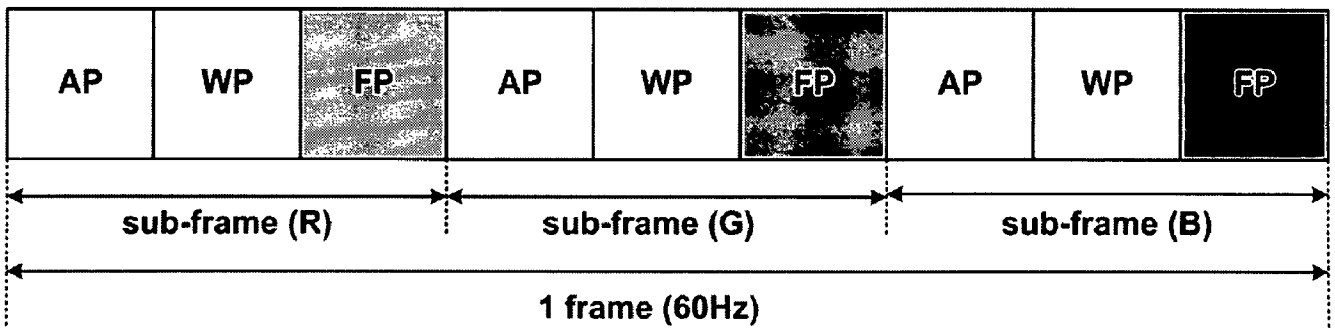
Fig. 1 (Related Art)
FIG. 1 is a timing chart that explains a method for driving a liquid crystal display of a field sequential color type according to the prior art.

As shown in FIG. 4*b*, as compared to FIG. 1, it is seen that the wait period VWP is increased by d1+d2, the addressing period VAP is decreased by d1, and the flash period VFP is decreased by d2.

As shown in FIG. 4*c*, as compared to FIG. 1, it is seen that the flash period VFP is increased by d3, the addressing period VAP is decreased by d3, and the flash period VWP is maintained as it is.

As shown in FIG. 4*d*, it is seen that the wait period and the flash period are set to the minimum wait period WP and the minimum flash period FP, and the addressing period VAP can be varied to the maximum. As shown in FIG. 4*e*, it is seen that the addressing period and the flash period are set to the minimum addressing period AP and the minimum flash period FP, and the wait period VWP can be varied to the maximum. As shown in f FIG. 4*f*, it is seen that the addressing period and the wait period are set to the minimum addressing period WP and the minimum wait period FP, and the flash period VFP can be varied to the maximum.

In a case where the frame frequency is varied, the sub-frame R can be varied in response to the varied frame frequency.

Figures 5, 6:
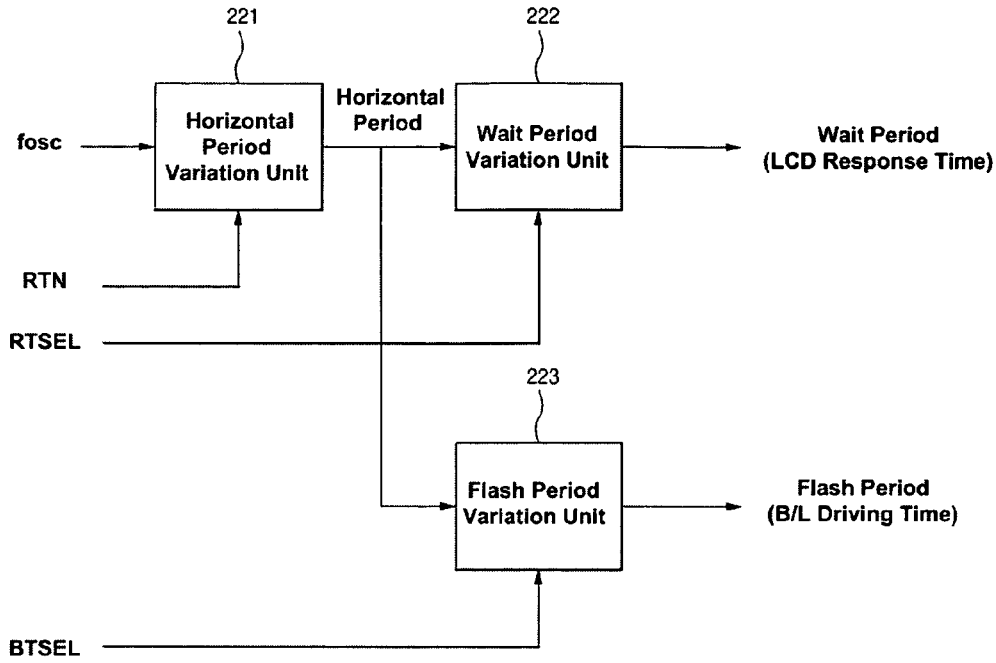
FIG. 5 is a block diagram that shows the sub-field time setting unit in more detail.
FIG. 6 is a table that shows one example of a wait period and a flash period according to a user setting in the sub-field time setting unit.

FIG. 5 is a block diagram that shows the sub-field time setting unit in more detail. FIG. 6 is a table that shows one example of a wait period and a flash period according to a user setting in the sub-field time setting unit.

As shown in FIG. 5, the sub-field time setting unit 350 comprises a horizontal period variation unit 221, a wait period variation unit 222, and a flash period variation unit 223.

The horizontal period variation unit 221 receives a frame frequency fosc, and selects 1 horizontal period that corresponds to the frame frequency fosc according to a horizontal period setting signal RTN, which is a first user-set signal, to output it to the wait period variation unit 222 and the flash period variation unit 223.

The wait period variation unit 222 determines a wait period WP according to 1 horizontal period and a wait period setting signal RTSEL, which is a second user-set signal, and the flash period variation unit 223 determines a flash period FP according to 1 horizontal period and a flash period setting signal BTSEL, which is a third user-set signal.

A user can set the wait period setting signal RTSEL and the flash period setting signal BTSEL that determines the wait period WP and the flash period FP, according to an ambient temperature and a luminance deviation. The first to third user-set signals RTN, RTSEL, and BTSEL are variable values according to a user's selection, and each of them can be provided in a lookup table stored in a memory.

FIG. 6 is a table showing one example of a wait period and a flash period according to a user setting in the sub-field time setting unit.

As shown in FIG. 6, an example of the design of a timing chart for the case where the liquid crystal display is provided at a mobile phone, and the timing chart time as shown in FIG. 6 is stored in a built-in memory will be described below.

In an initial environment, in a case where 5h'10, 001, and 001 are stored in first to third registers in the memory as default values of the horizontal period setting signal RTN, the wait period setting signal RTSEL and the flash period setting signal BTSEL, the horizontal period becomes 2.50 μs, and the wait period WP and the flash period FP can be set to a time corresponding to 170 clocks and 340 clocks, under the condition that the horizontal period is one clock period.

In a low temperature test environment, when a picture quality degradation occurs because a liquid crystal response speed is lengthened, the wait period WP can be increased by changing the second register value to 011. The values stored in the first and third register can be kept or changed.

Figure 7:
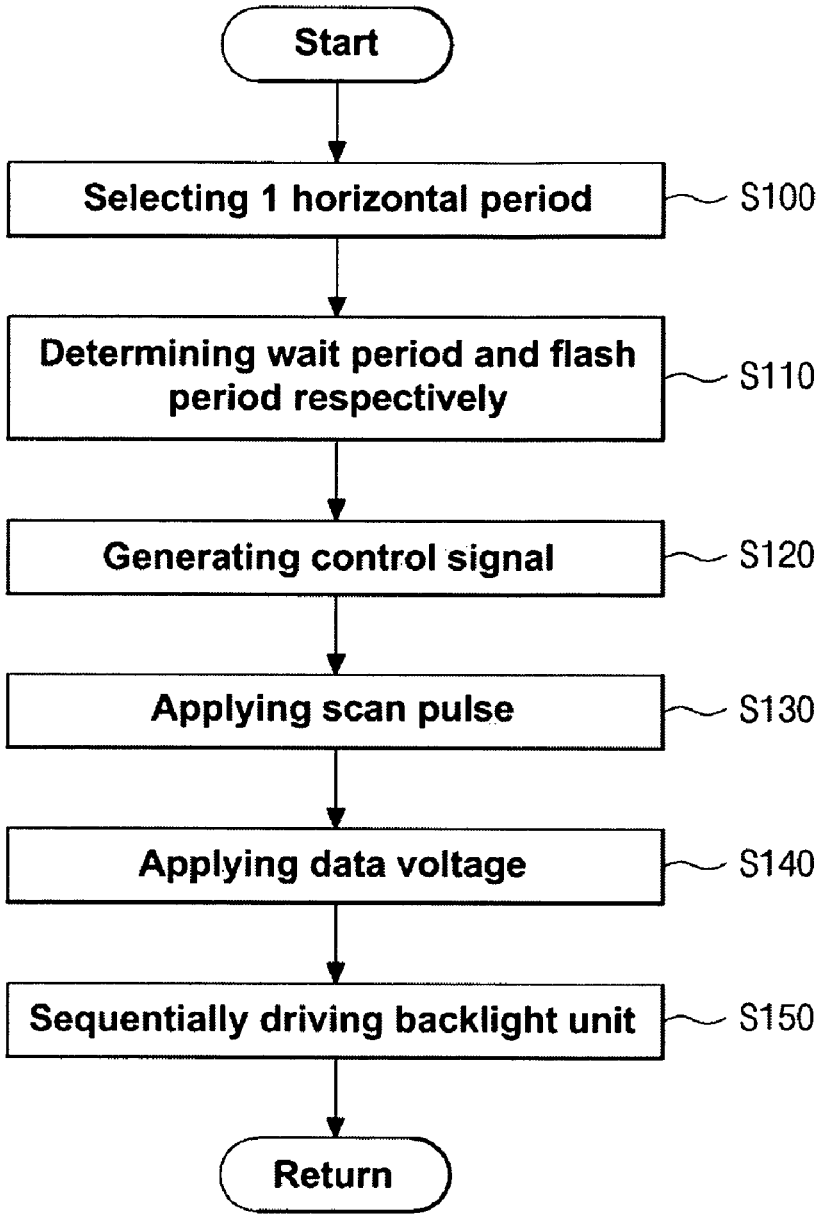
FIG. 7 is a flow chart that shows a method for driving a liquid crystal display of a field sequential color type in accordance with the one embodiment of the present invention.

FIG. 7 is a flow chart that shows a method for driving a liquid crystal display of a field sequential color type in accordance with the present embodiment.

In the step S100, a sub-field time setting unit 250 selects 1 horizontal period that drives data lines DL of an LCD panel 100 according to an externally input frame frequency fosc and a first user-set signal RTN.

In the step SI 110, the sub-field time setting unit 250 determines a wait period WP and a flash period according to the 1 horizontal period and a second user-set signal RTSEL and a third user-set signal BTSEL, and outputs them to a timing controller 210.

In the step S120, the timing controller 210 generates and outputs a gate control signal and a data control signal corresponding to the 1 horizontal period and the wait period WP, a light source control signal corresponds to the flash period FP, and re-aligned pixel data.

In the step S130, a gate driver 220 sequentially outputs a scan pulse to gate lines of the LCD panel 100 according to the gate control signal.

In the step S140, a data driver 230 converts pixel data into a data voltage using gamma voltages, and applies the data voltage to the data lines DL every 1 horizontal period according to the data control signal.

In the step S150, a backlight unit 300 sequentially outputs red, green, and blue light according to the light source control signal so as to display an image on the LCD panel 100.

Although the embodiments have been described with reference to the accompanying drawings, it will be understood by those skilled in the art that the invention can be implemented in other specific forms without changing the technical spirit or essential features of the invention.

Therefore, the above-described embodiments are provided to make those skilled in the art to fully understand the scope of the present embodiments, and it should be noted that the forgoing embodiments are merely illustrative in all aspects and the scope of the invention is only defined by the appended claims.

The liquid crystal display of the field sequential color type in accordance with the embodiments can increase a design margin upon designing a driving timing chart by varying each of fields in sub-frames comprising one frame, increase a design margin upon designing a timing chart, improve picture quality characteristics by reducing a luminance deviation generated when the frame frequency is increased and reducing degradations in color reproduction and contrast ratio (C/R) at a low temperature, and reduce power consumption when the same luminance is generated.

The method for driving a liquid crystal display of a field sequential color type in accordance with the embodiment can drive such a liquid crystal display efficiently.

What is claimed is:

1. A field sequential color type liquid crystal display comprising:

a LCD panel that has a plurality of pixels arranged in a matrix form defined by gate lines and data lines that cross each other;

a memory configured to store a first user-set data which includes a horizontal period, a second user-set data which includes a wait period of liquid crystals and a third user-set data which includes a flash period of driving a backlight unit, the first to third user-set data being variable;

a horizontal period variation unit that receives a frame frequency, selects 1 horizontal period corresponding to the frame frequency according to the first user-set data from the memory;

a wait period variation unit that varies a wait period according to the 1 horizontal period and the second user-set data from the memory;

a flash period variation unit that varies a flash period according to the 1 horizontal period and the third user-set data from the memory;

a timing controller that produces and outputs a gate control signal and a data control signal that corresponds to the 1 horizontal period and the wait period and a light source control signal corresponding to the wait period and a re-aligned pixel data;

a gate driver that sequentially outputs a scan pulse to the gate lines according to the gate control signal; and a data driver that outputs a data voltage to the data lines every 1 horizontal period according to the data control signal, wherein the backlight unit that sequentially outputs red, green and blue light to the pixels according to the light source control signal, wherein one frame comprises three sub-frames of red, green and blue, and each of the sub-frames is composed of three sub-fields that consists of a variable addressing period that corresponds to the 1 horizontal period, the wait period and the flash period.

2. The liquid crystal display of claim 1, wherein the wait period and the flash period can be set according to an ambient temperature or a luminance deviation.

3. The liquid crystal display of claim 1, wherein each of the variable three sub-fields consists of a minimum setup time and a variable time.

4. A field sequential color type liquid crystal display comprising:

a LCD panel that has a plurality of pixels arranged in a matrix form defined by gate lines and data lines that cross each other;

a memory configured to store a first user-set data which includes a horizontal period, a second user-set data which includes a wait period of liquid crystals and a third user-set data which includes a flash period of driving a backlight unit, the first to third user-set data being variable;

a frequency modulation unit that modulates an externally input frame frequency that corresponds to one frame;

a horizontal period variation unit that receives a frame frequency, selects 1 horizontal period corresponding to the frame frequency according to the first user-set data from the memory;

a wait period variation unit that varies the wait period according to the 1 horizontal period and the second user-set data from the memory;

a flash period variation unit that varies the flash period according to the 1 horizontal period and the third user-set data from the memory;

a timing controller that produces and outputs a gate control signal and a data control signal that corresponds to the 1 horizontal period and the wait period and a light source control signal that corresponds to the wait period and a re-aligned pixel data;

a gate driver that sequentially outputs a scan pulse to the gate lines according to the gate control signal; and a data driver that outputs a data voltage to the data lines every 1 horizontal period according to the data control signal, wherein the backlight unit that sequentially outputs red, green and blue light to the pixels according to the light source control signal, wherein one frame comprises three sub-frames of red, green and blue, and each of the sub-frames is composed of three sub-fields each consisting of a variable addressing period that corresponds to the 1 horizontal period, the wait period and the flash period.

5. The liquid crystal display of claim 4, wherein the wait period and the flash period can be set, according to an ambient temperature or a luminance deviation.

6. A method for driving a liquid crystal display of a field sequential color type, comprising:

storing a first user-set data which includes a horizontal period, a second user-set data which includes a wait period of liquid crystals and a third user-set data which includes a flash period of driving a backlight unit on a memory, the first to third user-set data being variable;

selecting 1 horizontal period for driving gate lines of an LCD panel according to the first user-set data from the memory if a frame frequency that corresponds to one frame is externally input;

varying a wait period according to the 1 horizontal period and the second user-set data;

varying a flash period according to the 1 horizontal period and the third user-set data producing and outputting a gate control signal and a data control signal that corresponds to the 1 horizontal period and the wait period and a light source control signal corresponding to the wait period and a re-aligned pixel data;

sequentially outputting a scan pulse to the gate lines according to the gate control signal;

converting the pixel data into a data voltage and outputting the data voltage to the data lines every 1 horizontal period according to the data control signal; and sequentially outputting red, green and blue light according to the light source control signal, wherein the one frame comprises three sub-frames of red, green and blue, and each of the sub-frames is composed of three sub-fields that consist of a variable addressing period that corresponds to the 1 horizontal period, the wait period and the flash period.

7. The method of claim 6, wherein the step of selecting 1 horizontal period that drives gate lines of an LCD panel comprises:

modulating the externally input frame frequency; and selecting 1 horizontal period that drives the gate lines of the LCD panel according to the modulated frame frequency and the first user-set data.

8. The method of claim 6, wherein the the wait period and flash period is set according to an ambient temperature or a luminance deviation.

* * * * *